United States Patent [19]

Bischofberger et al.

[11] Patent Number: 4,601,164

[45] Date of Patent: Jul. 22, 1986

[54] AUTOMAT LOCATION SYSTEM

[75] Inventors: Jürg Bischofberger, Elsau; Andrè Lattion, Seuzach, both of Switzerland

[73] Assignee: Rieter Machine Works, Ltd., Winterthur, Switzerland

[21] Appl. No.: 611,610

[22] Filed: May 18, 1984

[30] Foreign Application Priority Data

May 24, 1983 [GB] United Kingdom ..... 8314305

[51] Int. Cl.[4] ..... D01H 15/02

[52] U.S. Cl. ..... 57/263; 57/1 R; 57/81

[58] Field of Search ..... 57/80, 81, 261–263, 57/1 R, 407, 412; 242/35.5 R, 36

[56] References Cited

U.S. PATENT DOCUMENTS 3,511,045 5/1970 Bures et al. ..... 57/407
3,651,628 3/1972 Harmon et al. ..... 57/1 R
3,810,352 5/1974 Miyazaki et al. ..... 57/263
4,060,963 12/1977 Stahlecker et al. ..... 57/263 X
4,125,990 11/1978 Stahlecker et al. ..... 57/263
4,192,129 3/1980 Stahlecker ..... 57/263 X

FOREIGN PATENT DOCUMENTS 1349425 4/1974 United Kingdom .

*Primary Examiner*—John Petrakes
*Attorney, Agent, or Firm*—Kenyon & Kenyon

[57] ABSTRACT

Each cover of a spinning station is provided with a rail element for guiding the service tender along the aligned spinning stations. In addition, the service tender carries a guide means in the form of a roller which has a cylindrical part to roll on the rail element of the covers when the covers are in a closed position as well as a frustoconical part for rolling on the rail elements when the covers are in an open condition.

9 Claims, 11 Drawing Figures

Fig. 1
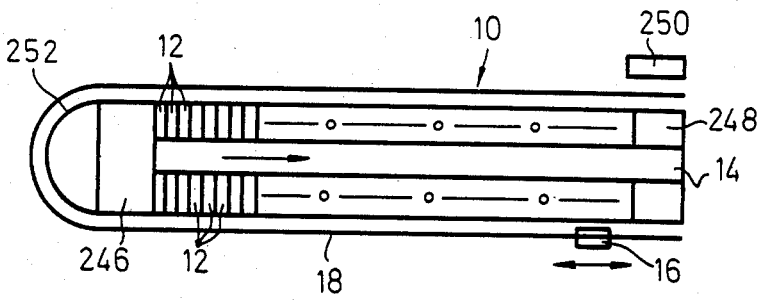
Fig. 2
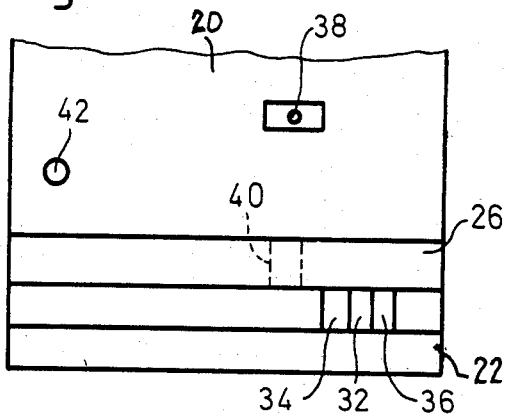
Fig. 3
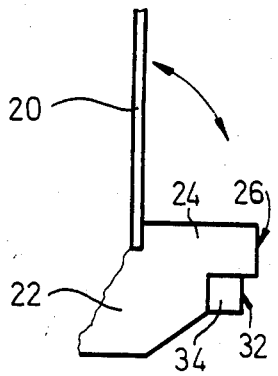
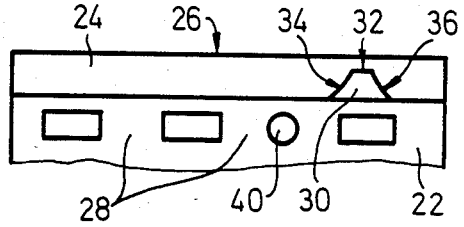
Fig. 4

AUTOMAT LOCATION SYSTEM

The present invention relates to systems for driving, guiding and locating relatively moving parts. More particularly, the invention relates to a system for driving, guiding and locating a service tender relative to a textile machine, in particular an open end spinning machine.

It is now conventional practice to provide a service tender or carriage to travel along multi-station thread-processing machines (e.g. spinning machines, winders, twisters, etc.) the tender being adapted to perform predetermined service operations on a selected station. For this purpose, the tender must be moved, guided and finally accurately located relative to the individual selected station.

It is common practice extending over many years to move the tender to and fro past the operating stations at a relatively high running speed until a call signal is received from a station requiring service. The tender is then slowed down to a crawling speed as it approaches the calling station, this lower speed facilitating the subsequent locating operation - see e.g. U.S. Pat. No. 3,810,352.

As is well described in the introduction to U.S. Pat. No. 3,651,628, the guidance and drive system for a service tender can present significant problems.

Briefly, the invention provides a guide means for guiding a tender along a plurality of aligned spinning stations in which each station includes a part which is pivotable between a first position for closing the station and a second position for opening the station. In addition, each part has a rail element thereon on which the service tender is to be guided. Further, the guide means includes a first guide element on the tender for movably contacting the rail element in the first position thereof, i.e. the closed position, and a second guide element for movably contacting the rail element in the second position thereof, i.e. the open position.

The guide means may be in the form of a roller which has a cylindrical part defining the first guide element and a frusto-conical part defining the second guide element.

The arrangement of the guide means is such that the tender may be guided on the pivotable part of each spinning station whether the part is in the closed position or the open position.

The arrangement of the guide means is such that the spinning station may be opened deliberately to indicate a fault condition which cannot be handled by the service tender but without providing a signal which would be recognized by the tender causing the tender to stop unnecessarily.

Figure 5:
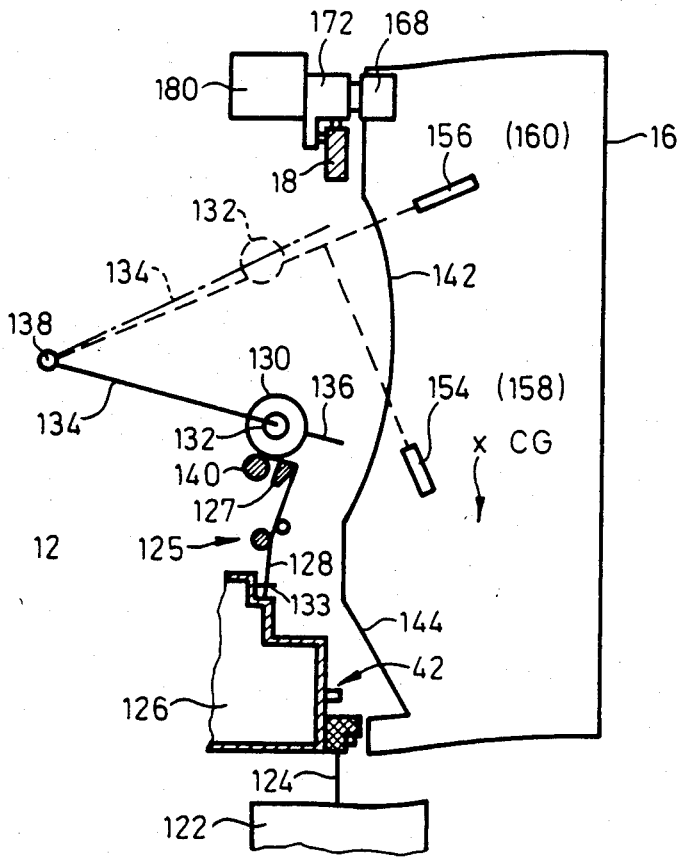
Figure 6:
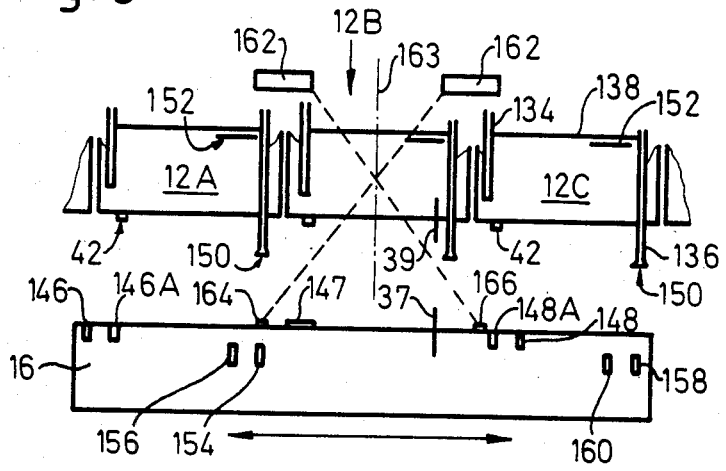
Figure 7:
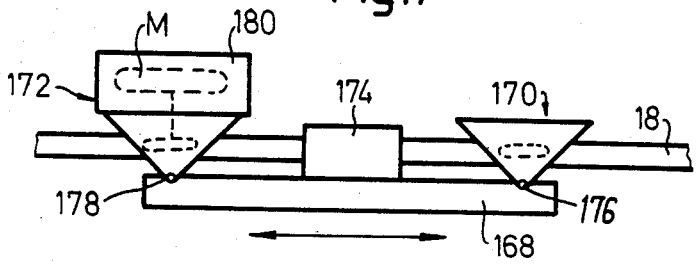
Figure 8:
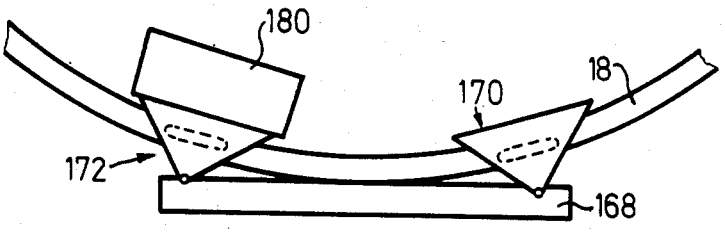
Figure 9:
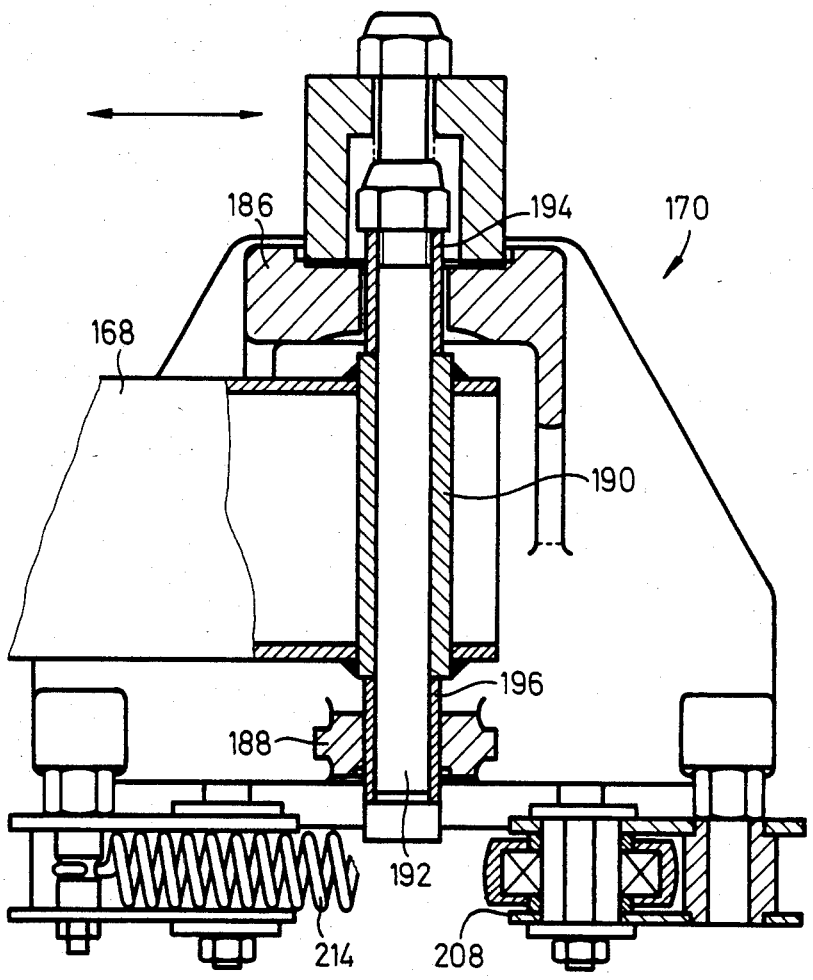
Figure 10:
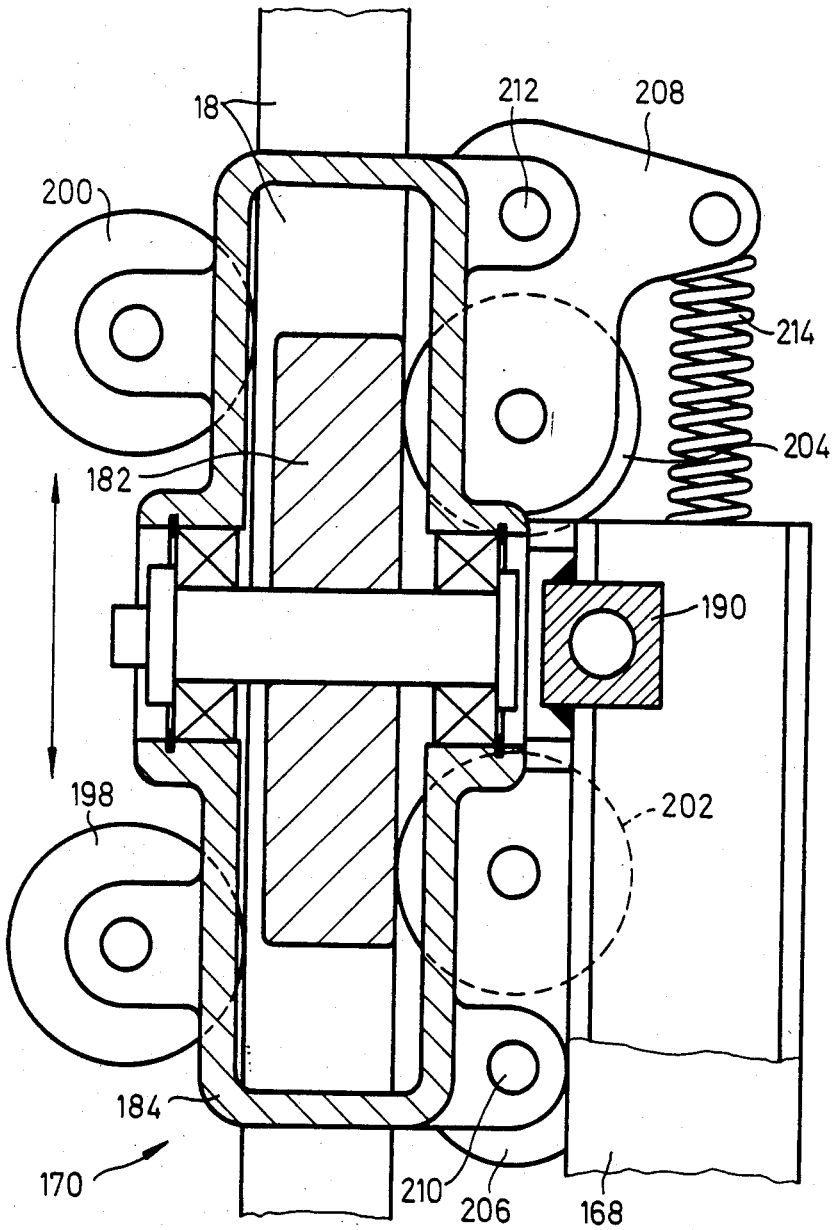
Figure 11:
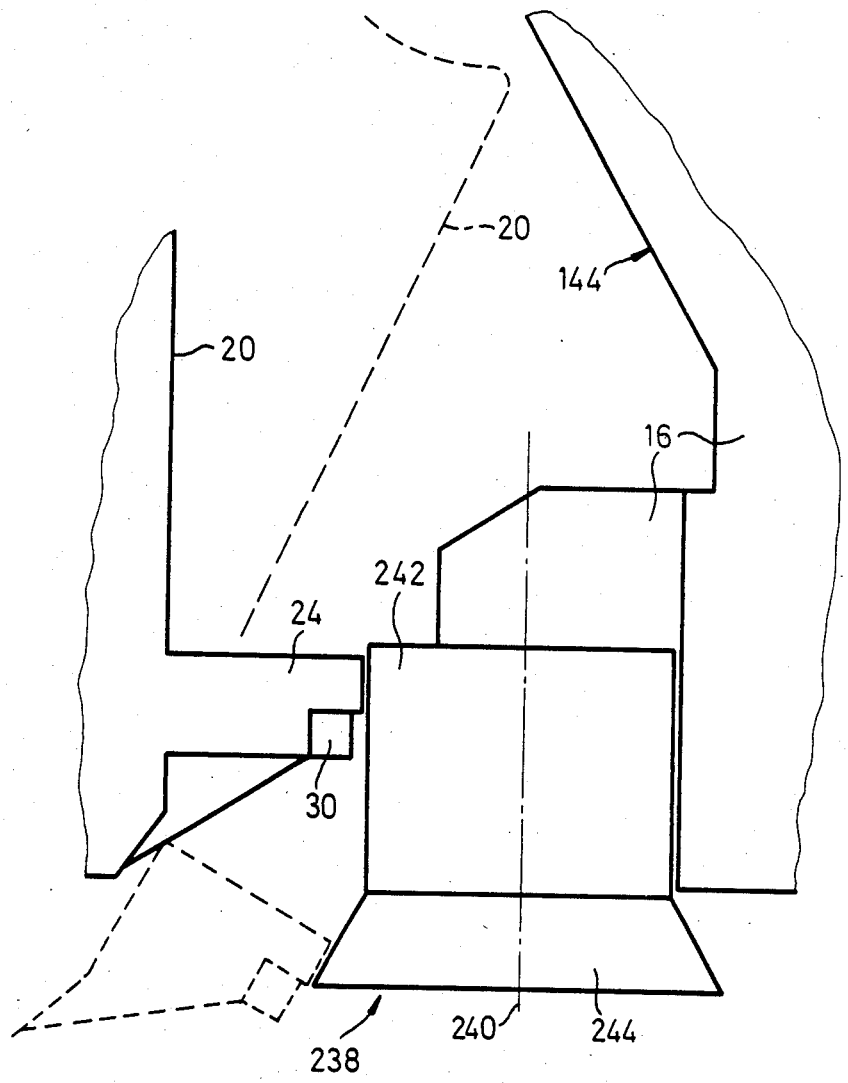

These and other objects and advantages of the invention will become more apparent from the following detailed description taken in conjunction with the accompanying drawings wherein:

FIG. 1 is a diagrammatic plan view of an open end spinning machine to which the invention can be applied, FIG. 2 is a diagrammatic front elevation of a face plate of a spinning unit suitable for the machine of FIG. 1, FIG. 3 is a side view of the plate shown in FIG. 3, FIG. 4 is an underplan of a rail element shown in FIGS. 2 and 3, FIG. 5 is a highly diagrammatic elevation of one spinning station of an open end spinning machine such as that shown in FIG. 1, FIG. 6 is a diagrammatic plan view of several adjacent spinning stations such as those shown in FIG. 5, FIG. 7 is a diagrammatic plan view of a wheel assembly for a service tender shown on a straight section of rail, FIG. 8 illustrates a diagrammatic plan view of the wheel assembly on a bend of the rail, FIG. 9 is a sectioned elevation of a wheel assembly as shown in FIGS. 7 and 8, FIG. 10 is a plan view of a wheel assembly as shown in FIG. 9, and FIG. 11 shows further details of a tender guide system.

GENERAL

Open end spinning machine 10 is an elongated structure having two rows of spinning stations 12 ranged on opposite sides of the machine. It is current conventional practice to provide approximately 100 spinning stations per machine side. The stations are designed to operate independently of one another, each receiving its own feed of fibre material and processing its feed to produce a yarn which is wound into a package. When the package at a particular station reaches a substantially predetermined length, the spinning operation at that station can be stopped and a package can be "doffed". In this doffing operation, the package is removed from its normal operating position in the spinning station and is transferred to a conveyer 14 which runs along the center of the machine and transfers the package to one end thereof. A fresh bobbin tube can then be mounted in the operative position in the respective spinning station 12, and the spinning operation at that station can be restarted.

Occasionally, the thread at a particular station will break before completion of winding of a package of the required length. When this occurs, a "piecing" operation must be carried out. In this operation, the broken end from the package and the feed material are brought together under carefully controlled conditions in the actual spinning unit of the spinning station, so that the continuous spinning operation is thereby restarted. The most likely cause of a thread break is accumulation of dirt in the spinning unit. It is therefore currently common practice to carry out "preventive maintenance" involving interruption of the spinning operation, even though that operation is currently performing satisfactorily, and cleaning of the spinning unit. Following such a preventive maintenance operation, a normal piecing operation must be carried out because of the intentional thread break caused by the interuption.

Details of all of the above operations are well known in the spinning art, and it is not believed necessary to repeat them in this specification. By way of example only, reference may be made to U.S. Pat. No. 4,125,990 for description of a doffing operation, to U.S. Pat. No. 3,810,352, for description of a piecing operation, and to U.S. Pat. No. 4,192,129 for description of a preventive maintenance operation.

The above cited references are not to be taken in any way as exclusive. Many other specifications, and much relevant literature, could be cited to show similar or alternative systems for performing the various operations outlined above. The cited references do, however, show the currently conventional practice of performing these operations by means of one or more patrolling service tenders. Such a tender is indicated schematically at 16 in FIG. 1 and it is suspended from a U-shaped rail extending along both sides and around one end of the machine 10.

In order to avoid unnecessary detail in the present specification, it will be assumed that tender 16 is designed to perform all of the operations outlined above. The invention is equally applicable to alternative systems, also known in the art, in which separate tenders are provided for performing the individual operations, such as piecing and doffing.

The illustrated tender 16 runs back and forth from one end of its rail 18 to the other, the direction of movement of the tender being reversed at each rail end. This can be effected, for example, by a simple trip switch at each rail end. If all spinning stations are spinning, then the tender will maintain its continuous movement back and forth without interruption. However, it will be scanning the stations during such movement, and when it detects a "disturbance" at one station, it will stop and perform an appropriate operation at that station. The "disturbance" may be completion of a package, an undesired thread break or interruption of spinning because preventive maintenance is due. A signalling system for indicating the disturbance to the tender is described in co-pending U.S. application Ser. No. 611,746, filed May 18, 1984. Whichever operation is to be performed, however, the tender 16 must locate accurately relative to the appropriate station.

SPINNING UNITS

Firstly, some parts of the locating system provided on the individual spinning units of the machine itself will be described with reference to FIGS. 2 to 4. FIG. 2 shows in elevation the front face of one spinning unit. A face plate 20 is secured by any suitable means (not shown) to a carrier portion 22 at the bottom edge of the plate. Carrier portion 22 is secured by a suitable mounting (not shown) in the structure of the machine 10. The mounting permits pivotal movement of the carrier 22 about an axis extending longitudinally of the machine, thus permitting pivotal movement of the plate 20 as indicated by the arrows in FIG. 3.

A latch (not shown) is provided to hold the plate 20 in the vertical position shown in FIG. 3, in which position the spinning unit is closed. Upon releasing the latch, the plate 20, and its carrier 22, will pivot in a clockwise direction as viewed in FIG. 3, thereby opening the unit to give access to the operating parts therein. Since none of those parts is relevant to the present invention, no further description of the interior of the spinning unit will be included in this specification. The principles of a mounting system can be seen from U.S. Pat. No. 3,511,045.

In addition to plate 20, carrier 22 supports a rail element 24 extending longitudinally of the machine. When the spinning unit is closed, rail 24 presents a surface 26 disposed in a vertical plane as seen in FIG. 3. When all of the spinning units on one side of the machine 10 are closed, the surfaces 26 on their respective rail element 24 are disposed in substantially the same vertical plane. These surfaces 26 provide a guide surface for one or more rollers (not shown) provided on the tender 16 and serving to support the tender against any tendency to swing on its suspension from rail 18.

LOCATING MARKERS

As can be appreciated from FIGS. 3 and 4 taken together, the rail member 24 is of an inverted L-shape in cross section, the vertical leg of the L being joined to the carrier member 22 by struts 28 (FIG. 4). The face 26 is therefore provided on the horizontal leg of the L. Adjacent one end of the element 24, and integral therewith, is a locating element 30. As best seen in FIG. 4, element 30 is triangular in plan with the base of the triangle merging into the vertical leg of the L-shaped rail element 24. The "peak" of the triangle is flattened and the resulting surface 32 is disposed inwardly (with regard to the machine 10) of the guide surface 26. Surface 32 merges with side surfaces 34 and 36 respectively which are disposed at predetermined equal angles with respect to the guide surface 26.

FIG. 2 also shows the sliver inlet 38 through which fibre sliver is fed into the interior of the spinning unit in use. The sliver must be fed to the inlet 38 between the rail element 24 and the carrier 22, and a guide opening 40 is provided for this purpose. Numeral 42 in FIG. 2 indicates a signal lamp indicating a "disturbance" in a spinning unit. As will be further described later, the tender 16 is arranged to respond to this lamp.

SPINNING STATION STATES

FIG. 5 is a highly diagrammatic representation of a single spinning station 12, showing also the tender 16 and its suspension rail 18.

Numeral 122 indicates a can containing infeed sliver 124 which is drawn from the can into the spinning unit 126 where it is converted into a yarn 128. The yarn is drawn out of the unit 126 by rolls 125 and passes over guide 127 to be wound into a package 130. The package forms on a bobbin tube 132 held between arms 134, 136 (FIG. 6) secured to a carrier 138 pivotally mounted in the machine structure.

The tube 132 is rotatably carried in its arms 134, 136 and the package and tube are rotated during formation of the package by frictional contact with a friction roll 140 (FIG. 5) which is incorporated in the machine structure and driven by the machine. Carrier 138 is pivotable to move arms 134, 136 between a lowermost position enabling contact of an empty tube 132 with the friction roll 140, and an uppermost position in which even a package of the maximum dimensions for which the machine is designed will be spaced from the friction roll 140.

The arms 134, 136 and carrier 138 together make up a package "cradle" which is part of a well-known "cradle mechanism" (not shown). The cradle mechanism includes a weighting or loading system which normally urges the cradle downwardly to apply a controlled winding pressure between a package and the friction roll. However, the cradle mechanism includes an over-centre system such that when the cradle is moved over the dead point of the over-centre system, the resilient bias of the weighting system will urge the cradle into a set upper position in which the cradle is stable. Such systems are shown, for example, in British Patent Specification 1349425.

The representation of the tender 16 in FIG. 5 shows the outline of one end plate of the tender frame and the location of the center of gravity CG such that the lower part of the tender is urged by gravity towards the rail elements 24. During running of the tender, longitudinally of the machine, all of the operating parts designed to perform service operations on a spinning station must be maintained within the outline shown in FIG. 5 to avoid interference between the running tender and the spinning stations.

In this respect, the curved recess 142 in the upper part of the end plate, and the triangular recess 144 in the lower part thereof, are to be particularly noted. Recess 142 enables the tender to clear the ends of the arms 136. The purpose of the recess 144 will be explained further below.

FIG. 6 shows in diagrammatic plan the relationship between the sizes of the tender 16 and the spinning stations 12 as viewed longitudinally of the machine. As shown there, the tender extends over slightly more than three spinning stations. After receiving a call signal from a station requiring service, the tender will locate itself with the calling station at about the mid-line of the tender. Thus, assuming that the tender is correctly located for performing service operations in FIG. 6, then such operations are to be performed on the spinning station 12B in that figure.

WHEEL ASSEMBLIES

The diagrams in FIGS. 7 and 8 show a tubular bearer 168 which is mounted on the rail 18 by wheel assemblies 170 and 172 and which carries the remaining structure of the fully assembled tender (not shown). Between the wheel assemblies 170 and 172, bearer 168 also carries a securing device 174 (FIG. 7, omitted from FIG. 8). Wheel assembly 170 is a loadbearing assembly and is pivotally connected to the bearer 168 by a pin joint 176. Wheel assembly 172 is a load bearing and drive assembly, and is also pivoted to the bearer 168 by a pin joint 178. Wheel assembly 172 includes additional structure 180 containing drive motor M for the tender and any required gearing coupling that drive motor with the wheel of assembly 172.

The pivotal connections between the wheel assemblies and bearer 168 enable continued adequate drive contact between the wheel assembly 172 and the rail 18 as the tender travels around the U-bend in the rail 18 at one end of the machine 10 (FIG. 1, part also in FIG. 8). As seen in FIG. 8, the wheel assemblies 170, 172 adapt their orientation to the bearer 168 automatically as the tender passes around the rail bend.

FIGS. 9 and 10 show further details of a suitable wheel assembly 170. The wheel which rests on the upwardly facing surface of rail 18 and supports the weight of the tender is shown at 182 (FIG. 10). The wheel is journalled in a housing 184 having side projections 186, 188 (FIG. 9) respectively above and below the bearer 168. The bearer 168 is cut away to receive an elongated, vertically oriented bearing block 190, which is welded into the cutout. Block 190 has a longitudinal bore receiving a bearing pin 192 retained at its ends in tubular portions 194, 196 secured to the projections 186, 188 respectively. Thus the housing 184 can pivot on the longitudinal axis of pin 192.

Housing 184 also carries four guide rollers 198, 200, 202, 204. These rollers are mounted to hang below the housing 184 when it is mounted on the rail 18, and to engage the side surfaces of the rail. Each roller is rotatable about a vertical axis, the axes of the rollers 198, 200 being fixed relative to the housing 184. The axes of the rollers 202, 204 are carried on dog-leg levers 206, 208 which are pivotably mounted on the housing 184 at 210, 212 respectively. The ends of the levers remote from rollers 202, 204 are joined by a tension spring 214 drawing the joined ends of the levers together and thereby urging the rollers against the side surface of the rail 18. The "fixed" rollers 198, 200 are on the inside of the U-bend, and the spring-biased rollers 202, 204 are on the outside of that bend.

Rollers 198, 200 "steer" the wheel assembly around the bend, that is, they force the assembly to adapt its angular orientation on pivot pin 192 to the bend.

The wheel assembly 172 is the same in all essential respects as the wheel assembly 170. However, the housing 184 carries the additional structure 180 shown in the diagrams of FIGS. 12 and 13. Further, the journal bearing holding the wheel 182 in the housing 184 of wheel assembly 170 is replaced in wheel assembly 172 by a suitable drive connection with the motor in the structure 180.

GUIDE ROLLERS

It will be noted that the weight of the tender is carried solely by the rail 18; no weight is borne by the rail sections illustrated in FIGS. 2 to 4. However, those rails provide guidance against forces tending to swing the tender about an axis extending longitudinally of the bearer 168. Provided all the spinning stations of a machine side are closed during running of the tender, the rail elements 24 shown in FIG. 2 will provide a substantially continuous rail along each machine side, and suitable U-shaped extension rails can be provided around the machine end. However, it may be desired to leave specific spinning stations open while still permitting the tender to travel along the machine attending to the other stations. For example, where individual spinning stations are automatically disconnected from the machine drive system when they are opened, it may be desired to leave defective stations open. The recess 144 shown in FIG. 5 ensures that there is no interference between the travelling tender and an open spinning station. However, the lower rail provided by the rail elements 24 is no longer continuous in these circumstances. FIG. 11 illustrates an arrangement for providing transverse guidance of the tender even when its lower guides are adjacent an opened spinning station.

FIG. 11 is a view similar to FIG. 3 but showing also the lower portion of the tender 16 adjacent the spinning stations. The rail element 24 and the front plate 20 of one spinning station are shown in full lines in the closed position corresponding with FIG. 3. Tender 16 has a guide roller mounted in the tender by means (not shown) so as to be rotatable about a vertical axis 240. Guide roller 238 has a cylindrical portion 242 and a frusto-conical portion 244.

When the spinning units are closed, the cylindrical portion 242 of roller 238 engages the vertical, outwardly facing surfaces of the rail elements 24. When a spinning unit is left open, its front plate 20 and rail element 24 lie in the dispositions indicated by dotted lines in FIG. 11. The frusto-conical portion 244 of the roller 238 now engages the same guide surface on the rail element 24 as previously, but that guide surface is now inclined at an angle to the vertical. The angle of the frusto-cone of portion 244 must of course correspond to the angle of pivot permitted to plate 20 and rail element 24 by the design of the individual spinning units of the machine. The illustrated angle is purely exemplary and in no way limiting. Depending upon the overall layout and the operating circumstances, it may well be found unnecessary to provide the frusto-conical portions 244, adequate guidance being achieved by purely cylindrical guide rollers engaging the rail elements 24. In any event, the tender 16 preferably has a plurality of guide rollers which preferably engage rail elements 24 on respective different spinning units. Preferably further, guide rollers are provided adjacent the leading/trailing edges of the tender 16 so that during a service operation the tender is supported on spinning units to either side of a spinning station which is being serviced.

Any convenient means may be used to mount the guide rolls in the tender 16. For example, vertical bearer pins could be secured in holders which are releasably secured in the body of the tender 16, the guide rollers (e.g. roller 238) being rotatable on respective bearer pins.

MACHINE LAYOUT

As indicated in FIG. 1, the spinning stations 12 do not normally extend to the ends of an open end spinning machine. At one end of the machine there is normally a head stock 246 containing the drive motors and gear transmissions for the complete machine. At the other end, there may be a unit 248 containing further parts required for operation of the machine as a whole, e.g. a fan required to induce suction air flows in the individual spinning stations 12. There may also be equipment designed to handle doffed packages arriving on the conveyor belt 14. Such equipment is normally provided at the open end of the U-shaped rail system 18, so that the rail and the tender 16 running thereon do not interfere with access to the doffed packages arriving at the machine end. Where the tender 16 is designed to act as an automatic doffer, a bobbin tube loader 250 may also be provided adjacent one end of the rail system 18 to enable periodic replenishment of the stock of bobbin tubes in a magazine (not shown) carried by the tender 16.

The lower rails, constituted by the rail elements 24 at the spinning stations 12 should clearly be extended by suitable extension elements on the units 246 and 248. This will enable firm support of the tender 16 on both sides of the end stations 12 while the tender is performing service operations on those stations. A curved extension 252 of the lower rail can also be secured to the head stock 246. The complete set of guide rollers carried by the tender 16 should be such that the tender does not swing about the upper rail 18 as it passes around the curved portion of that rail. For this purpose, it may be necessary to provide the tender 16 with additional guide rollers, the rotational axes of which are relatively close together when compared with the spacing of the axes of the main guide rollers 238 described above. These additional guide rollers are then suitably located to engage a tightly curved extension 252 and to maintain the upright orientation of the tender 16 as it passes around the rail curve. Preferably, these additional rollers are slightly displaced vertically above or below the main rollers 238, so that the additional rollers do not engage the rail elements 24 at the spinning stations and do not interfere with the action of the main rollers 238 in ensuring accurate upright disposition of the tender 16 during service operations on individual spinning stations 12.

Regarding the wheel assemblies shown in FIGS. 7–10, the assembly steering rollers 198, 200 also act as retainers for the tender. This is not essential. Desirably, however, retaining devices are disposed on one side of the load-bearing wheels and the centre of gravity of the complete tender is disposed on the other side so that the retainers are drawn into contact with the rail structure. The axes of the steering rollers do not have to be disposed at right angles to the axes of the load-bearing wheels; furthermore, the distribution of loading between the various wheels of the assembly can be adapted as required, so that there may be more than one load-bearing wheel in each assembly. The drive motor is preferably connected directly to the drive wheel or wheels without any intervening clutch mechanism, control therefore being effected by the energisation of the drive motor.

With regard to the lower guide system shown in FIG. 11, any desired means may be used to hold the spinning unit in its open position as shown in that Figure, e.g. reference may be made to U.S. Pat. No. 3,511,045, the content of which is hereby incorporated by reference into this specification. The desired guide surfaces on the tender for cooperating with the rail element 24 in its two positions may be made separate instead of being incorporated into a unitary body as shown in FIG. 11. The guide surface on the rail element does not have to be vertical when the spinning unit is closed, although this is preferred. The guide surface may be non-planar.

The invention is not limited to a service tender which travels in opposite directions relative to the machine during normal running. It is known, e.g. to provide a continuous rail around the machine so that the service tender travels in one direction only on this continuous rail.

Further, the invention is not limited to open end spinning machines. Specifically, the invention may be used with automatic winders and filament texturising machines.

I claim:

1. An open end spinning machine having a plurality of spinning stations and a service tender movable along a predetermined path past said stations, each station comprising a spinning unit having a part pivotable between a first position in which said spinning unit is closed and a second position in which said spinning unit is open, said part being retainable in each said position, each said part providing a rail element, guide means on said tender including a first guide element to engage said rail element on a part in said second position thereof.

2. A machine as claimed in claim 1 wherein each said guide element makes rolling contact with said rail elements.

3. A machine as claimed in claim 1 wherein each said rail element presents a guide surface to said tender, said guide surface being presented for contact with said first guide element when said rail element is in said first position and for contact with said second guide element when said rail element is in said second position.

4. A machine as claimed in claim 3 wherein said guide surface is planar and lies in a substantially vertical plane when said respective part is in said first position.

5. A machine as claimed in claim 1 wherein said guide elements are provided on a single body.

6. A machine as claimed in claim 5 wherein said body is a roller, said first guide element is a cylindrical part of said roller and said second element is a frusto-conical part of said roller.

7. In combination, a plurality of aligned spinning stations, each station including a part pivotable between a first position for closing said station and a second position for opening said station, each respective part having a rail element thereon; and a service tender movable along said stations, said tender having a guide means for guiding said tender along said stations, said guide means including a first guide element for movably contacting said rail element in said first position thereof and a second guide element for movably contacting said rail element in said second position thereof.

8. The combination as set forth in claim 7 wherein said guide means includes a rotatably mounted roller having a cylindrical part defining said first guide element and a frusto-conical part defining said second guide element.

9. The combination as set forth in claim 7 wherein said tender includes at least a pair of said guide means, each said guide means being disposed at a respective leading edge of said tender and a trailing edge of said tender.

* * * * *